US005608504A

United States Patent [19]

Furusawa et al.

[11] Patent Number: 5,608,504

[45] Date of Patent: Mar. 4, 1997

[54] TRANSFER MATERIAL DETECTING DEVICE

[75] Inventors: Fumio Furusawa; Akira Kamata; Tomohisa Suzuki, all of Ebina, Japan

[73] Assignee: Fuji Xerox Co., Ltd., Tokyo, Japan

[21] Appl. No.: 543,137

[22] Filed: Oct. 13, 1995

[30] Foreign Application Priority Data

Dec. 16, 1994 [JP] Japan ..... 6-313798

[51] Int. Cl.[6] ..... G03G 15/16

[52] U.S. Cl. ..... 399/18

[58] Field of Search ..... 355/203, 205, 355/206, 271, 316

[56] References Cited

U.S. PATENT DOCUMENTS

| | | | |
|---|---|---|---|
| 3,620,616 | 11/1971 | Davidson et al. | 355/206 |
| 4,247,193 | 1/1981 | Kaneko et al. | 355/206 |
| 4,541,711 | 9/1985 | Takahashi | 355/208 |
| 4,935,776 | 6/1990 | Fukui | 355/206 |
| 5,043,771 | 8/1991 | Shibata et al. | 355/317 |
| 5,049,924 | 9/1991 | Moro et al. | 355/50 |
| 5,406,358 | 4/1995 | Kimura et al. | 355/271 |
| 5,440,382 | 8/1995 | Suga | 355/205 X |

FOREIGN PATENT DOCUMENTS 58-11965 1/1983 Japan .

*Primary Examiner*—Arthur T. Grimley
*Assistant Examiner*—Sophia S. Chen
*Attorney, Agent, or Firm*—Oliff & Berridge

[57] ABSTRACT

A transfer material detecting device contains a transfer material carrier that detachably carries a transfer material to transport the transfer material to a transfer region where a toner image of an image carrier is transferred to the transfer material; and transfer material sensors that are disposed in a moving path of the transfer material carrier and detect the existence of the transfer material carried by the transfer material carrier. The device contains at least two transfer material sensors arranged in a moving direction of the transfer material carrier at intervals that are shorter than the minimum size of the transfer material to be detected; and a device for outputting a transfer material detection signal when at least two of the transfer material sensors simultaneously detect the existence of the transfer material.

13 Claims, 16 Drawing Sheets

PRIOR ART

PRIOR ART

A DECTECTION SIGNAL OF A TRANSFER MATERIAL SENSOR

TRANSFER MATERIAL DETECTING DEVICE

BACKGROUND OF THE INVENTION

The invention relates to a transfer material detecting device which is useful in an image forming apparatus having a transfer material carrier, such as a color copier, or a color printer, and more particularly to a transfer material detecting device which detects a state where a transfer material stuck as a result of a jam remains held by a transfer material carrier. Such a transfer material detecting device is necessary for preventing a transfer material from being newly transported under a state where a previous transfer material remains carried by a transfer material carrier.

As a transfer drum of this kind, conventionally, the following technique is known.

(J01) Technique shown in FIGS. 14 and 15:

Referring to FIG. 15, a cylindrical photosensitive portion 02 is disposed at the center of the axial direction of a photosensitive drum 01. A photosensitive drum gear 03 is disposed at one end (the left end in FIG. 15) in the axial direction.

A toner image formed in the cylindrical photosensitive portion 02 of the photosensitive drum 01 is transferred to a transfer material carried by a transfer drum 06.

The transfer drum 06 shown in FIGS. 14 and 15 comprises a front drum 07 made of aluminum, a rear drum 08, and a drum tie plate 09 which connects the drums 07 and 08 with each other. Cylindrical members 011 and 012 for supporting a bearing are fixed to the center portions of the drums 07 and 08, respectively. The cylindrical members 011 and 012 are supported by a shaft member 013 via bearings (not shown). The shaft member 013 elongates outward from the drums 07 and 08 (see FIG. 14) so as to be supported by a frame (not shown) of an image recording apparatus.

A transfer film 014 (see FIG. 15) is stretched between the drums 07 and 08 so as to form a cylindrical shape. A transfer material (not shown) such as a recording sheet can be sucked to the cylindrical transfer film 014 by static electricity.

Referring to FIGS. 14 and 15, a ring-like driven gear (transfer drum gear) 016 is attached to the left end of the front drum 07 of the transfer drum 06. The transfer drum gear 016 engages with the photosensitive drum gear 03 of the photosensitive drum 01. A ring-like rubber belt 017 is disposed in the right side of the transfer drum gear 016. As shown in FIG. 15, the rubber belt 017 makes contact with the cylindrical face of the photosensitive drum 01 so that the distance (distance DDS, see FIG. 15) between the surface of the photosensitive portion 02 and that of the transfer film 014 is held at a predetermined value.

The rear drum 08 is not provided with a transfer drum gear. A rubber belt 018 (see FIG. 14) similar to the ring-like rubber belt 017 is disposed on the rear drum 08.

In the thus configured transfer drum, when a new image forming operation is started without removing a transfer material which is stuck on the transfer material carrier in a jam, a next transfer material is transported to the transfer material carrier on which the previous transfer material remains, thereby again causing a jam.

Therefore, the image forming operation must be started after ascertaining that no transfer material is held on the transfer material carrier.

As a technique for detecting that a transfer material exists at a predetermined position, conventionally, the following technique is known.

Technique disclosed in Japanese Patent Publication No. SHO. 58-11965:

The publication describes a method in which existence of a transfer material on a transfer material carrier is detected by using a transfer material sensor of the reflected light detection type disposed in a moving path of a transfer material carrier. Generally, a transfer material is higher in optical reflectivity than the transfer material carrier. Therefore, a transfer material can be detected by the sensor of the reflected light detection type.

However, the transfer material is not disposed in the whole of the periphery of the transfer material carrier. Therefore, in the case where only one transfer material sensor is disposed in the periphery of the transfer material carrier, even when a transfer material is held on the transfer material carrier, the occasion when the transfer material does not exist at the position opposing the transfer material sensor sometimes arises.

On this occasion, even when the material is held on the transfer material carrier, the transfer material sensor cannot detect the transfer material. Therefore, in the case where only one transfer material sensor is used, the transfer material carrier must be rotated in order to surely ascertain whether a transfer material is held on the transfer material carrier or not.

When a transfer material is to be detected while rotating the transfer material carrier, there is a problem as discussed below. In a configuration wherein, as shown in FIGS. 14 and 15, the transfer film (transfer material carrier) 014 is supported in a cylindrical shape by the pair of drums 07 and 08 and the drum tie plate 09, the amount of light reflected from the drum tie plate 09 is not obviously distinct from that of light reflected from the transfer material, and hence the detection signal from the transfer material sensor is unstable.

FIG. 16 is a diagram showing the output signal of the transfer material sensor. In FIG. 16, the area defined by a indicates a detection signal for light reflected from the drum tie plate, and the succeeding area defined by b is a transfer material detection signal. FIG. 16 shows the signals obtained in the case where the transfer material exists. If there is no transfer material, the signal in the area b of FIG. 16 has a low level.

As seen from FIG. 16, in the region of the drum tie plate 09 (see FIG. 14), it is difficult to judge whether a transfer material exists or not.

In other words, the afore-mentioned method has the problems as discussed below.

In an image forming apparatus wherein a transfer material holding member which is hardly distinguished from a transfer material moves along the same path as the transfer material, it is impossible to surely detect existence of the transfer material.

In view of the above-mentioned circumstances, it is an object of the invention to detect the existence of a transfer material on a transfer material carrier rapidly and surely.

Next, the invention which has been accomplished in order to meet the afore-mentioned and other objects will be described. In order to facilitate the understanding of the relationships between the components of the invention and those of embodiments described later, the components of the invention are accompanied by parenthesized reference numerals of the corresponding elements of the embodiments. The reason why the invention will be described in correspondence with the reference numerals of the embodiments described later is to facilitate the understanding of the invention, and it is not intended to restrict the scope of the invention to the embodiments.

SUMMARY OF THE INVENTION

The transfer material detecting device according to a first aspect of the invention comprises a transfer material carrier (31) which detachably carries a transfer material (P) to transport the transfer material to a transfer region (B) where a toner image of an image carrier (1) is transferred to the transfer material; and transfer material sensors (S1, S2, S3) which are disposed in a moving path of the transfer material carrier (31) and detect the existence of a transfer material (P) carried by the transfer material carrier (31), and characterized in that the device has the following requirements:

a plurality of transfer material sensors (S1, S2, S3) are arranged in a moving direction of the transfer material carrier (31) and at intervals which are shorter than a minimum size of a transfer material (P) to be detected; and the device further comprises a means for, when two or more of the transfer material sensors (S1, S2, S3) simultaneously detect the existence of the transfer material, outputting a transfer material detection signal, i.e., a transfer material detection signal outputting means.

The transfer material detecting device of a second aspect of the invention is characterized in that the transfer material detecting device of the first aspect further has the following requirement:

a transfer drum (27), comprising: a pair of drums (28, 29) which have a cylindrical transfer material carrier supporting face (45) in an outer peripheral portion; and a drum connecting member (30) which integrally connects the pair of drums (28, 29) with each other while separating the pair of drums (28, 29) from each other by a predetermined distance, the drum connecting member having a belt-like transfer material carrier holding face (52), the transfer drum being rotated while carrying the transfer material carrier in a cylindrical shape.

The transfer material detecting device of a third aspect of the invention is a transfer material detecting device, comprising: a transfer material carrier (31) which detachably carries a transfer material (P) to transport the transfer material to a transfer region (B) where a toner image of an image carrier (1) is transferred to the transfer material; and the transfer material sensors (S1, S2, S3) which are disposed in a moving path of the transfer material carrier (31) and detect the existence of a transfer material (P) carried by the transfer material carrier (31), and characterized in that the device has the following requirements:

a transfer drum (27), comprising: a pair of drums (28, 29) which have a cylindrical transfer material carrier supporting face (45) in an outer peripheral portion; and a drum connecting member (30) which integrally connects the pair of drums (28, 29) with each other while separating the pair of drums from each other by a predetermined distance, the drum connecting member having a belt-like transfer material carrier holding face (52), the transfer drum being rotated while carrying the transfer material carrier (31) in a cylindrical shape;

a carrier position detecting means (39) for detecting a rotation position of the transfer material carrier (31); and a means for, when the transfer material sensors (S1, S2, S3) detect the existence of a transfer material in a region other than the drum connecting member (30), outputting a transfer material detection signal, i.e., transfer material detection signal outputting means.

The transfer material detecting device of a fourth aspect of the invention is a transfer material detecting device, comprising: a transfer material carrier (31) which detachably carries a transfer material (P) to transport the transfer material to a transfer region (B) where a toner image of an image carrier (1) is transferred to the transfer material; and transfer material sensors (S1, S2, S3) which are disposed in a moving path of the transfer material carrier (31) and detect the existence of a transfer material (P) carried by the transfer material carrier (31), and characterized in that the device has the following requirements:

a transfer drum (27), comprising: a pair of drums (28, 29) which have a cylindrical transfer material carrier supporting face (45) in an outer peripheral portion; and a drum connecting member (30) which integrally connects the pair of drums (28, 29) with each other while separating the pair of drums from each other by a predetermined distance, the drum connecting member having a belt-like transfer material carrier holding face (52), the transfer drum being rotated while carrying the transfer material carrier (31) on a cylindrical face; and a region of the belt-like transfer material carrier holding face (52) is configured into a state where a signal indicative of nonexistence of a transfer material is output, the region being to be detected by the transfer material sensors (S1, S2, S3).

A first embodiment of the transfer material detecting device of the invention is characterized in that the device of the fourth aspect of the invention has a further requirement described below:

the region of the belt-like transfer material carrier holding face (52) which is to be detected by the transfer material sensor (S1, S2, S3) is colored in black.

Next, the function of the invention having the above-mentioned features will be described.

In the transfer material detecting device of the first aspect of the invention which has the above-mentioned features, the transfer material carrier (31) detachably carries a transfer material (P) and transports the material to a transfer region (B) where a toner image of an image carrier (1) is transferred to the transfer material. When the transfer material (P) held by the moving transfer material carrier (31) enters the detection regions of the plurality of transfer material sensors (S1, S2, S3), the transfer material sensors (S1, S2, S3) which are arranged in a moving direction of the transfer material carrier (31) and at intervals shorter than a minimum size of the transfer material (P) to be detected detect the existence of the transfer material.

When two or more of the transfer material sensors (S1, S2, S3) simultaneously detect the existence of the transfer material, the transfer material detection signal outputting means outputs a transfer material detection signal.

In the transfer material detecting device of the second aspect of the invention the transfer drum (27), comprises: the pair of drums (28, 29) each of which have a cylindrical transfer material carrier supporting face (45) in an outer peripheral portion; and a drum connecting member (30) which integrally connects the pair of drums (28, 29) with each other while separating the pair of drums (28, 29) from each other by a predetermined distance, and which has a belt-like transfer material carrier holding face (52). The transfer drum is rotated while carrying the transfer material carrier (31) in a cylindrical shape. Therefore, the transfer material carrier (31) is rotated about its axis while being held in a cylindrical shape.

In the transfer material detecting device of the third aspect of the invention, the transfer drum (27), comprises: the pair of drums (28, 29) which have a cylindrical transfer material carrier supporting face (45) in an outer peripheral portion;

and the drum connecting member (30) which integrally connects the pair of drums (28, 29) with each other while separating the pair of drums from each other by a predetermined distance, and which has a belt-like transfer material carrier holding face (52), and the transfer drum is rotated while carrying the transfer material carrier (31) in a cylindrical shape. Therefore, the transfer material carrier (31) is rotated about its axis while being held in a cylindrical shape. The transfer material carrier (31) detachably carries the transfer material (P) to transport the transfer material to the transfer region (B) where a toner image of the image carrier (1) is transferred to the transfer material.

When the transfer material (P) held by the moving transfer material carrier (31) enters the detection region of the transfer material sensor (S1, S2, S3) which is disposed in a moving path of the transfer material carrier (31), the transfer material sensors (S1, S2, S3) detect the existence of the transfer material. The carrier position detecting means (39) detects the rotation position of the transfer material carrier (31).

When the transfer material sensors (S1, S2, S3) detect the existence of the transfer material in a region other than the drum connecting member (30), the transfer material detection signal outputting means outputs a transfer material detection signal.

In the transfer material detecting device of the fourth aspect of the invention, the transfer drum (27), comprises: the pair of drums (28, 29) which have a cylindrical transfer material carrier supporting face (45) in an outer peripheral portion; and the drum connecting member (30) which integrally connects the pair of drums (28, 29) with each other while separating the pair of drums from each other by a predetermined distance, and which has a belt-like transfer material carrier holding face (52), and the transfer drum is rotated while carrying the transfer material carrier (31) in a cylindrical shape. Therefore, the transfer material carrier (31) is rotated about its axis while being held in a cylindrical shape. The transfer material carrier (31) detachably carries the transfer material (P) to transport the transfer material to the transfer region (B) where a toner image of the image carrier (1) is transferred to the transfer material.

When the transfer material (P) held by the moving transfer material carrier (31) enters the detection region of the transfer material sensors (S1, S2, S3) which are disposed in a moving path of the transfer material carrier (31), the transfer material sensors (S1, S2, S3) detect the existence of the transfer material. Since the region of the belt-like transfer material carrier holding face (52) which region is to be detected by the transfer material sensors (S1, S2, S3) configured into a state where a signal indicative of nonexistence of a transfer material is output, the transfer material sensors (S1, S2, S3) are prevented from erroneously detecting the belt-like transfer material carrier holding face (52) as the transfer material (P).

In Embodiment 1 of the transfer material detecting device of the invention, the region of the belt-like transfer material carrier holding face (52) which region is to be detected by the transfer material sensors (S1, S2, S3) is colored in black. When there is no transfer material (P), therefore, a signal indicative of the nonexistence of a transfer material is output. Consequently, the transfer material sensors (S1, S2, S3) are prevented from erroneously detecting the belt-like transfer material carrier holding face (52) as the transfer material (P).

BRIEF DESCRIPTION OF THE DRAWINGS

FIG. 7 illustrates a drum tie plate (drum connecting member) of the transfer drum shown in FIG. 3.

DETAILED DESCRIPTION OF THE PREFERRED EMBODIMENTS

Hereinafter, embodiments of the invention will be described with reference to the accompanying drawings. The invention is not restricted to the embodiments.

Embodiment 1

Figure 1:
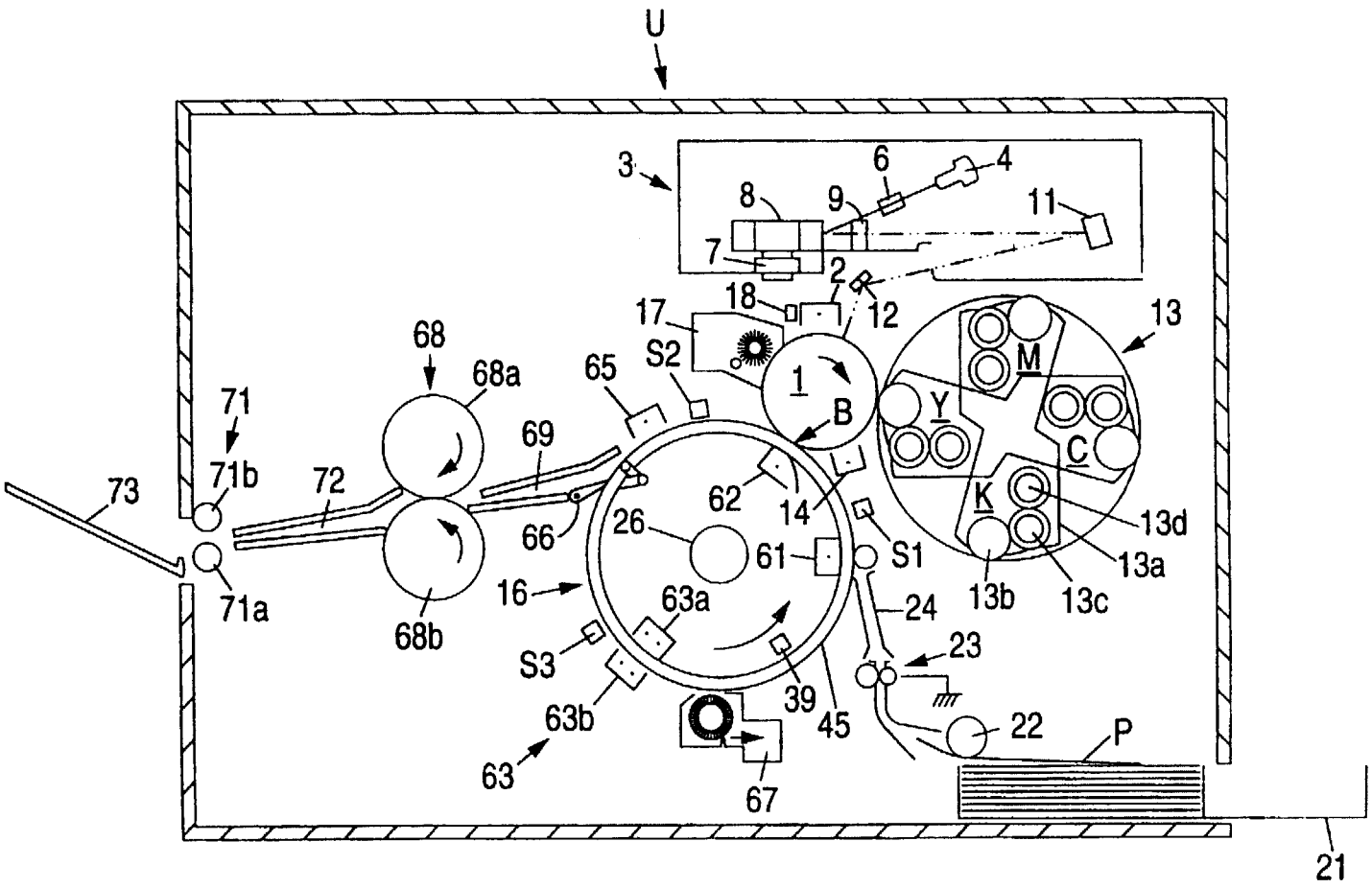
FIG. 1 is a diagram illustrating the whole of an image forming apparatus into which Embodiment 1 of the transfer material detecting device of the invention is incorporated.

Referring to FIG. 1, the image forming apparatus U into which Embodiment 1 of the transfer material detecting device of the invention is incorporated is a digital printer. The digital printer U has a cylindrical image carrier 1. A charge corotron 2 which uniformly charges the surface of the image carrier 1, and a laser writing device 3 which writes an electrostatic latent image on the charged surface of the image carrier 1 are arranged around the image carrier 1. The laser writing device 3 comprises a laser oscillator 4, a condenser lens 6, a polygon mirror 8 rotated by a motor 7, an Fθ lens 9, a cylindrical mirror 11, and a deflection mirror 12.

A color developer 13 is disposed in the periphery of the image carrier 1 or downstream from the laser writing device 3 in the rotation direction of the transfer material carrier. The color developer 13 comprises a yellow developer Y, a magenta developer M, a cyan developer C, and a black developer K which develop the electrostatic latent image with toners of yellow, magenta, cyan, and black, respectively.

The developers Y, M, C, and K are supported by a rotating member. When a latent image corresponding to a yellow toner image is formed by the laser writing device 3, the yellow developer Y is held at a developing position (the position where the developer makes contact with the image carrier 1). When a latent image corresponding to a toner image of another color is formed by the laser writing device 3, the yellow developer M, C, or K corresponding to the color is held at the developing position.

Each of the developers Y, M, C, and K comprises a developer case 13*a* which accommodates toner of the respective color, a developing roll 13*b* supported by the developer case 13*a*, a toner supplying roll 13*c* which supplies the toner to the developing roll 13*b*, and a stirring member 13*d* which stirs the toner in the developer case 13*a*.

A transfer auxiliary corotron 14, and a transferring device 16 are arranged in this sequence in the periphery of the image carrier 1 or downstream from the color developer 13 in the rotation direction of the transfer material carrier.

The transfer auxiliary corotron 14 reduces variations of the charging potential of the surface of the image carrier 1 on which the toner images are formed, so that toners are easily transferred from the image carrier 1 to the transfer material.

The transferring device 16 transfers the toner images on the image carrier 1 to the transfer material in a transfer region B where the transferring device makes contact with the image carrier 1. The transferring device 16 will be described later in detail.

A cleaning device 17, and an erase lamp 18 are arranged in this sequence in the periphery of the image carrier 1 or downstream from the transfer region B in the rotation direction of the transfer material carrier.

The cleaning device 17 recovers toners remaining on the surface of the image carrier 1.

The erase lamp 18 causes the potential of the surface of the image carrier 1 to be zero so that variations of the charging potential of the surface of the image carrier 1 is eliminated.

The digital printer U has a transfer material supply tray 21 in the lower right portion in FIG. 1. A transfer material feed roll 22 which feeds the transfer material P one by one from the transfer material supply tray 21 is disposed above the left end portion of the tray 21. The transfer material P which is fed from the transfer material supply tray 21 by the transfer material feed roll 22 is transported to the transferring device 16 by a registration roll 23 consisting of a driving roll and a driven roll, a paper chute 24, etc.

Next, the transferring device 16 will be described.

The transferring device 16 has a transfer drum 27 which is rotatably supported by a transfer drum supporting shaft 26.

Figure 3:
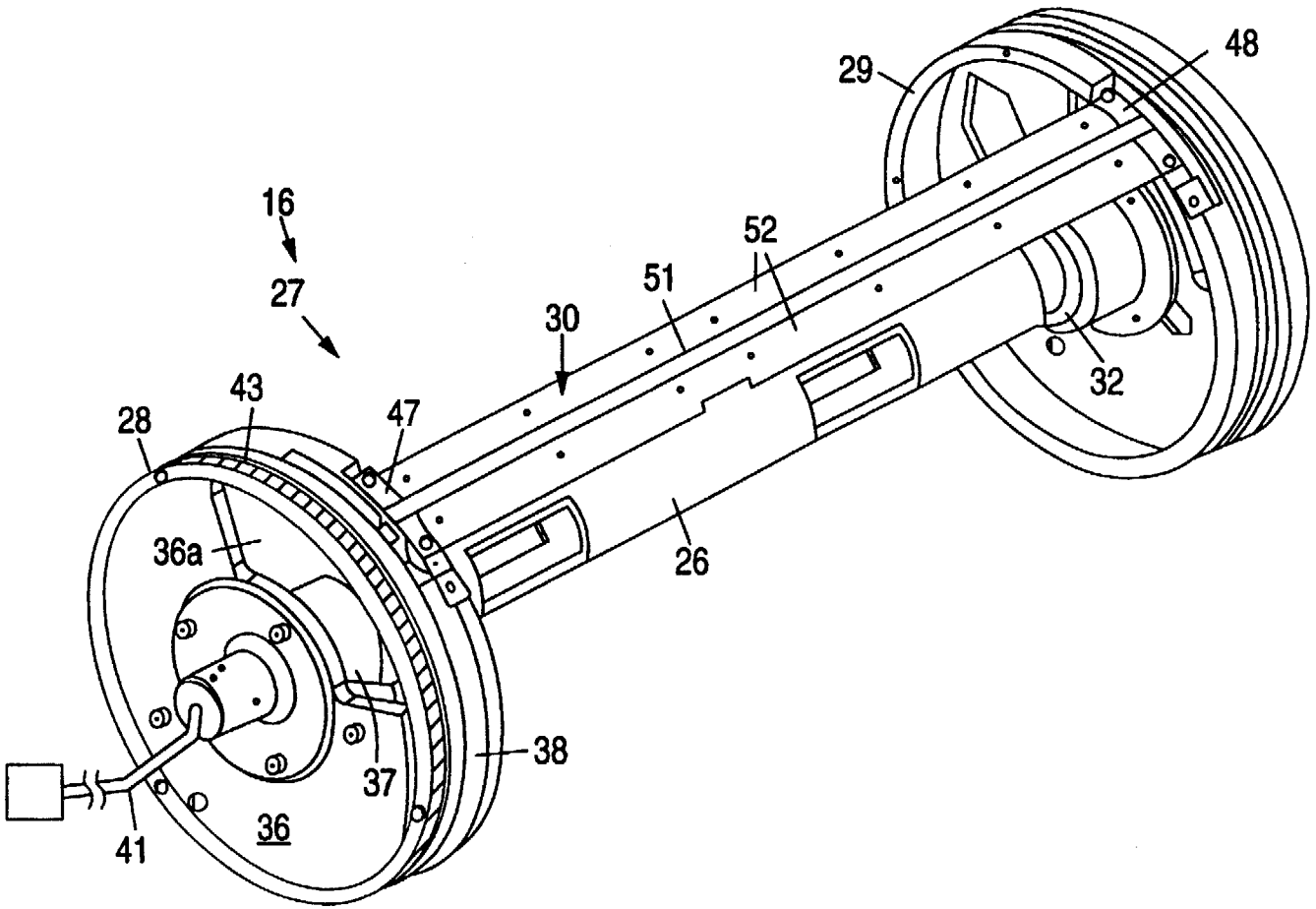
FIG. 3 is a perspective view of a transfer drum shown in FIG. 1.

As shown in FIG. 3, the transfer drum 27 comprises a front drum 28, a rear drum 29, a drum tie plate (i.e., the drum connecting member) 30, and a film-like transfer material carrier 31 which is supported by these components and shown in FIG. 7.

In FIG. 3, the front drum 28 which is a component of the transfer drum 27 is supported on one end portion of the transfer drum supporting shaft 26 via a bearing (described later), and the rear drum 29 is supported on the other end portion via a bearing 32 (its detail will be described later). The drums 28 and 29 are connected to each other by the belt-like drum tie plate 30.

Next, the front drum 28 will be described with reference to FIGS. 3 to 5.

Figure 4:
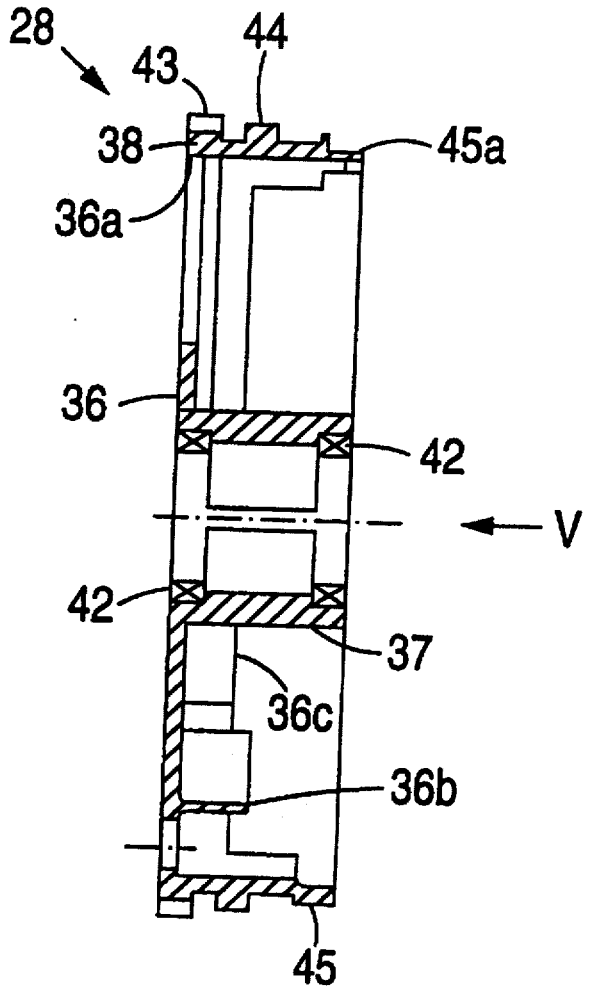
FIG. 4 is a longitudinal section view showing a front drum constituting the transfer drum of FIG. 3 and taken along line IV—IV of FIG. 5.
Figure 5:
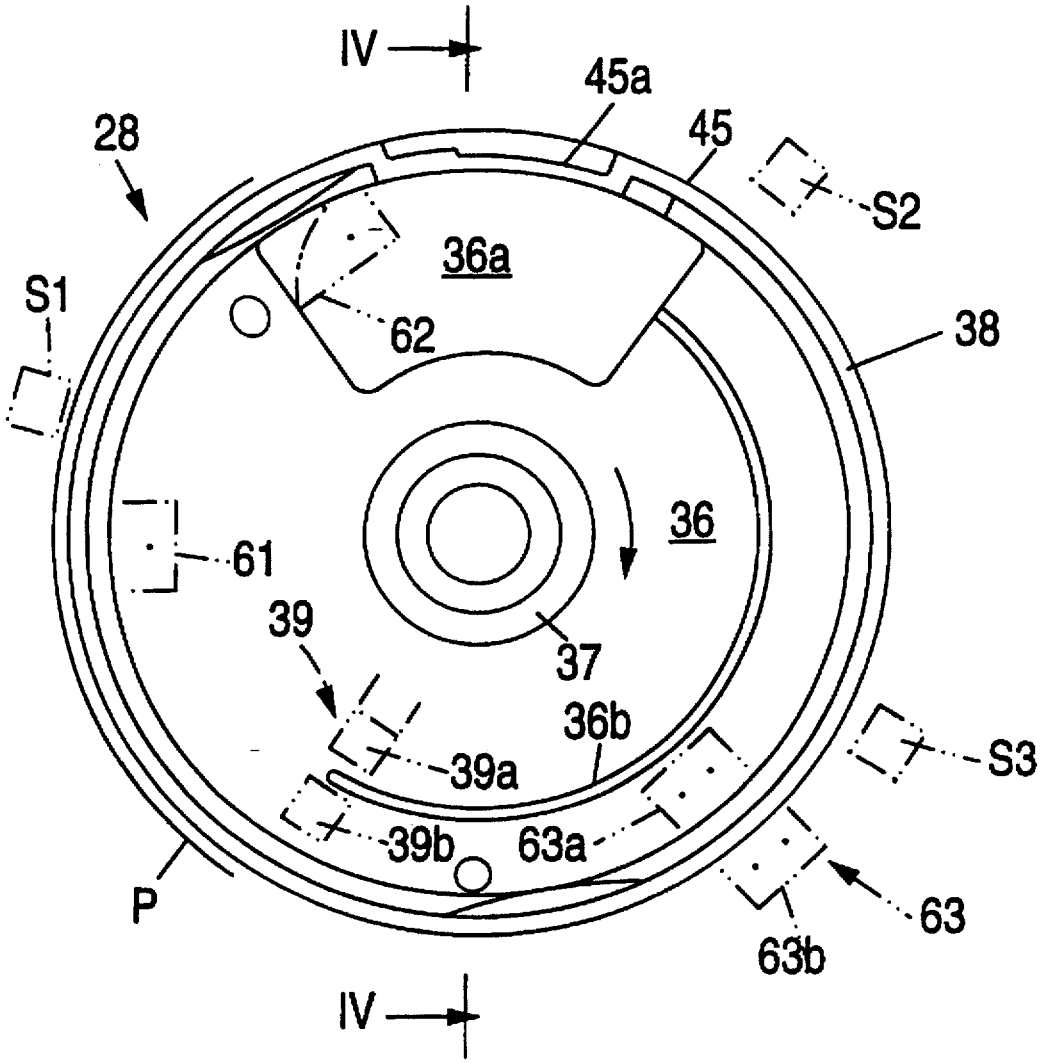
FIG. 5 is a view as seen from arrow V of FIG. 4.

The front drum 28 has a circular plate 36 in which a removed portion 36*a* of an adequate shape is formed, a center hub portion 37 which elongates from the center of the plate toward the inner side (the right portion in FIG. 3), and a cylindrical outer peripheral portion 38 which elongates from the outer periphery of the plate toward the inner side (the right portion in FIG. 4).

A light shield wall 36*b* for the rotation position detection, and a reinforcing rib 36*c* are disposed on the inner side face (the right side face in FIG. 4) of the circular plate 36 so as to elongate along the circumference. A light emitting device 39*a* and a light receiving device 39*b* which are respectively disposed in the both sides of the light shield wall 36*b* so as to face each other across the wall and indicated by two-dot chain lines in FIG. 5 are fixed to the transfer drum supporting shaft (which rotatably supports the transfer drum 27) 26, and used for detecting the rotation position of the transfer drum 27. Namely, the light emitting device 39*a* and the light receiving device 39*b* constitute a drum position sensor (i.e., the carrier position detecting means) 39 which detects the rotation position of the drum. Lead wire members 41 (see FIG. 3) such as a wire for supplying an electric power to the light emitting device 39*a*, and signal output lines for the light receiving device 39*b* pass through the inside of the transfer drum supporting shaft 26 to elongate to the outside of the transfer drum 27.

Bearings 42 (see FIG. 4) are attached to the both end portions in the axial direction (the lateral both end portions in FIG. 4) of the center hub portion 37 of the front drum 28, respectively.

Figure 15:
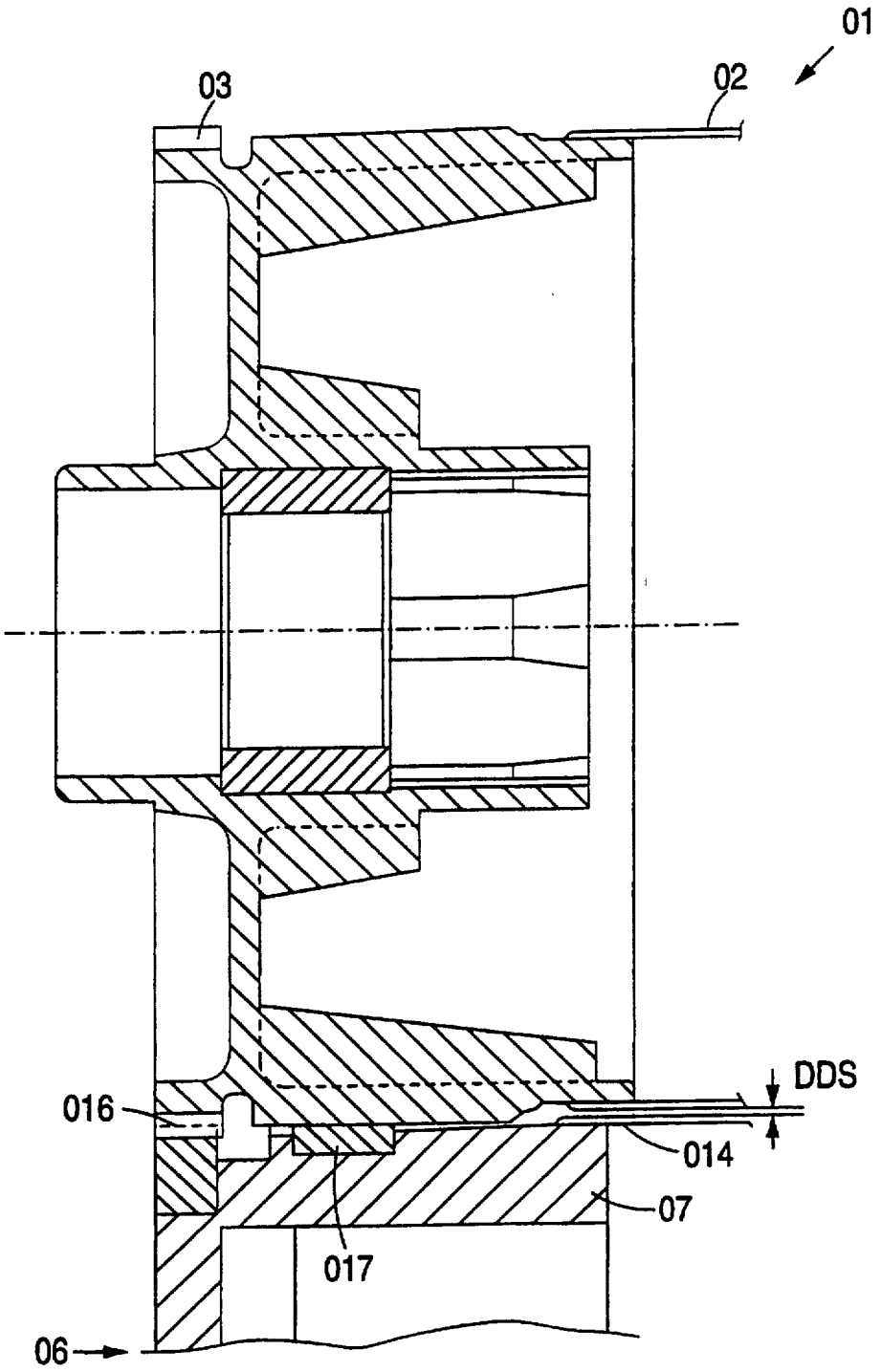
FIG. 15 is a diagram of the prior art and illustrating relationships between an image carrier and the transfer drum.
Figure 16:
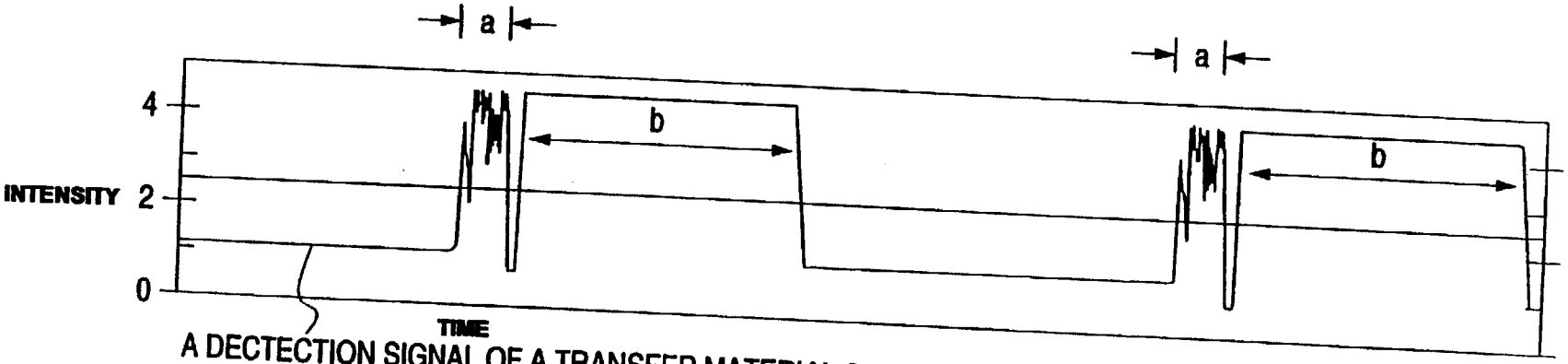
FIG. 16 is a diagram of the prior art and illustrating a detection signal of a transfer material sensor.

On the cylindrical outer peripheral portion 38 of the front drum 28, formed are a gear (transfer drum gear) 43 which engages with a gear (not shown, see the reference numeral 03 in FIG. 15 described in the prior art section) formed at an end portion in the axial direction of the image carrier 1, a transfer drum positioning cylindrical face 44 which makes contact with a positioning cylindrical face (not shown) of the image carrier 1, and a transfer material carrier supporting face 45 (see FIGS. 4 and 5) which is disposed at an inner end portion. A tie plate connecting recess 45*a* (see FIGS. 4 and 5) is formed on the transfer material carrier supporting face 45.

The rear drum 29 shown in FIG. 3 is configured in the same manner as the front drum 28 except that the light shield wall 36*b* and the gear 43 of the front drum 28 are not provided.

Figure 6:
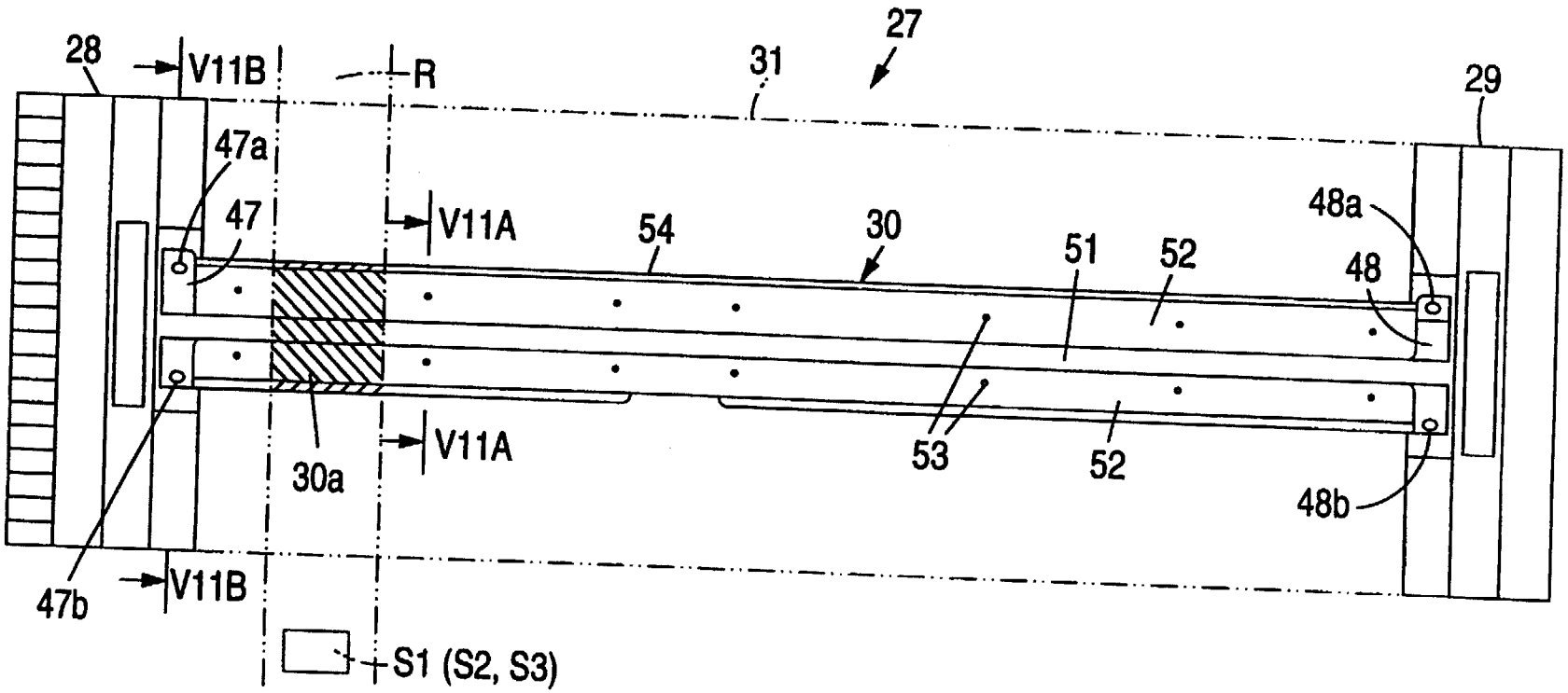
FIG. 6 is a view illustrating the relationships between the transfer drum shown in FIG. 3 and transfer material sensors.
Figure 7A:
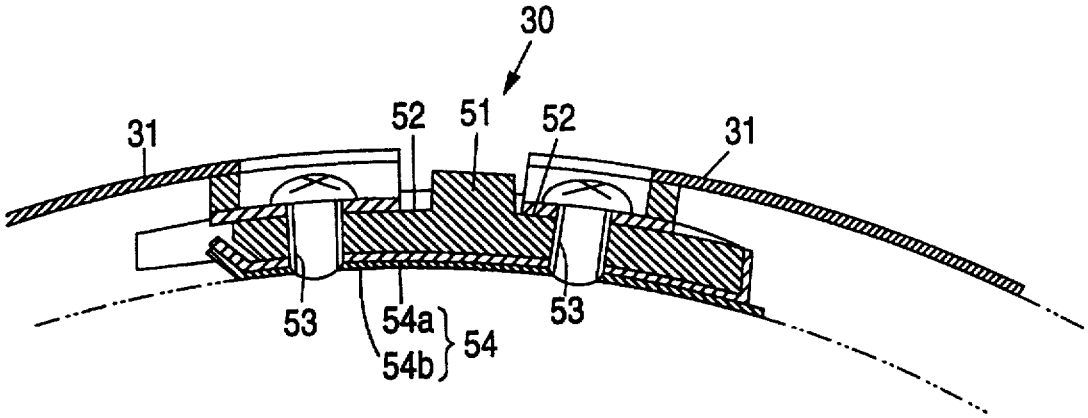
FIG. 7A is a section view taken along line VIIA—VIIA of FIG. 6.
Figure 7B:
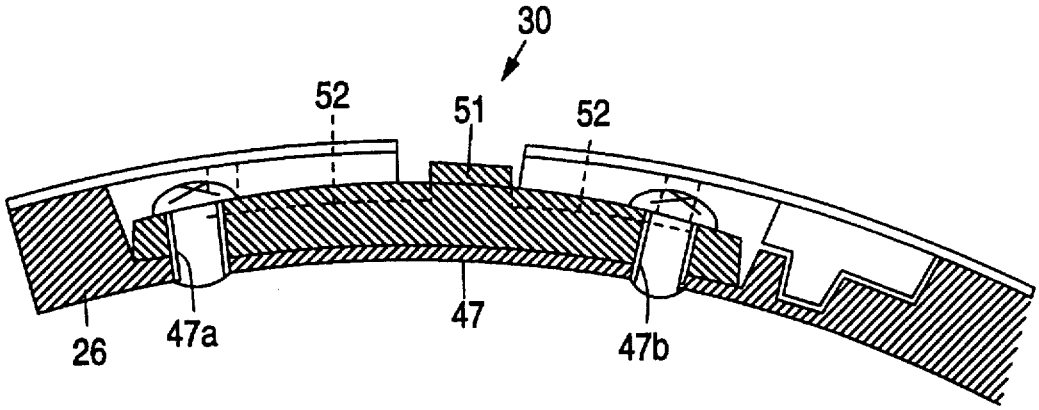
FIG. 7B is a section view taken along line VIIB—VIIB of FIG. 6.

The drum tie plate 30 shown in FIG. 3 is a member for integrally connecting the front drum 28 with the rear drum 29, and cooperates with the drums 28 and 29 to exhibit a function of supporting the transfer material carrier (transfer film) 31 (see FIG. 7). Referring to FIGS. 3, 6, and 7, a connecting portion 47 which is to be connected with the front drum 28 is disposed in one end portion of the drum tie plate 30, and a connecting portion 48 which is to be connected with the rear drum 29 is disposed in the other end portion. As seen from FIG. 7B, in each of the connecting portions 47 and 48, the portion in the lower face is removed away so as to be thinner than the center portion.

In the connecting portions 47 and 48, threaded holes 47*a* and 47*b*, and 48*a* and 48*b* for connecting the drum tie plate 30 to the front drum 28 and the rear drum 29 are formed, respectively.

The drum tie plate 30 is connected to the front drum 28 and the rear drum 29 by screws (see FIG. 7B) which are screwed in the threaded holes 47*a* and 47*b*, and 48*a* and 48*b*.

A ridge 51 which elongates in the longitudinal direction of the drum tie plate 30 is formed in the center portion of the lateral direction. In FIG. 7A, the portions which are on the both sides of the ridge 51 and lower than the ridge 51 are portions (transfer material carrier holding face) 52 for holding the transfer material carrier (transfer film for supporting a transfer material such as a recording sheet or paper) 31, and have threaded holes 53 for fixing the transfer material carrier.

An insulator assembly 54 is disposed on the inner face of the portion (portion shown in FIG. 7A) excluding the end portions in the longitudinal direction of the drum tie plate 30. The insulator assembly 54 comprises a plastic mold product 54*a*, and a MYLAR 54*b*, and has a function of electrically insulating the drum tie plate 30 made of aluminum from a transfer corotron disposed inside the transfer drum 27.

Figure 7C:
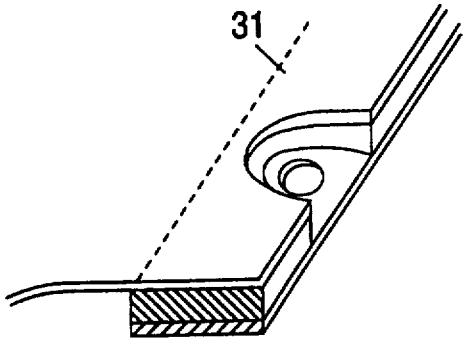
FIG. 7C is a diagram illustrating the structure of an end portion of a transfer material carrier 31 which is fixed to the drum tie plate 30 shown in FIG. 7A.

As shown in FIG. 7C, a reinforcing member for fixing the transfer material carrier 31 to the drum tie plate 30 is disposed at each of the both ends of the transfer material carrier 31. The both ends of the transfer material carrier 31 (see FIGS. 7A and 7C) are fixed to the transfer material carrier holding face 52 of the drum tie plate 30, and the side portions of the transfer material carrier 31 are supported by the cylindrical faces of the front drum 28 and the rear drum 29, respectively, with the result that the transfer material carrier 31 is held in a cylindrical shape by the front drum 28, the rear drum 29, and the drum tie plate 30.

The components designated by the reference numerals 28 to 31 constitute the transfer drum 27. The transfer drum 27 is rotatably supported by the transfer drum supporting shaft 26 via the bearings 32 and 42. Even when the transfer drum 27 is rotated, therefore, the transfer drum supporting shaft 26 is not rotated.

Figure 2:
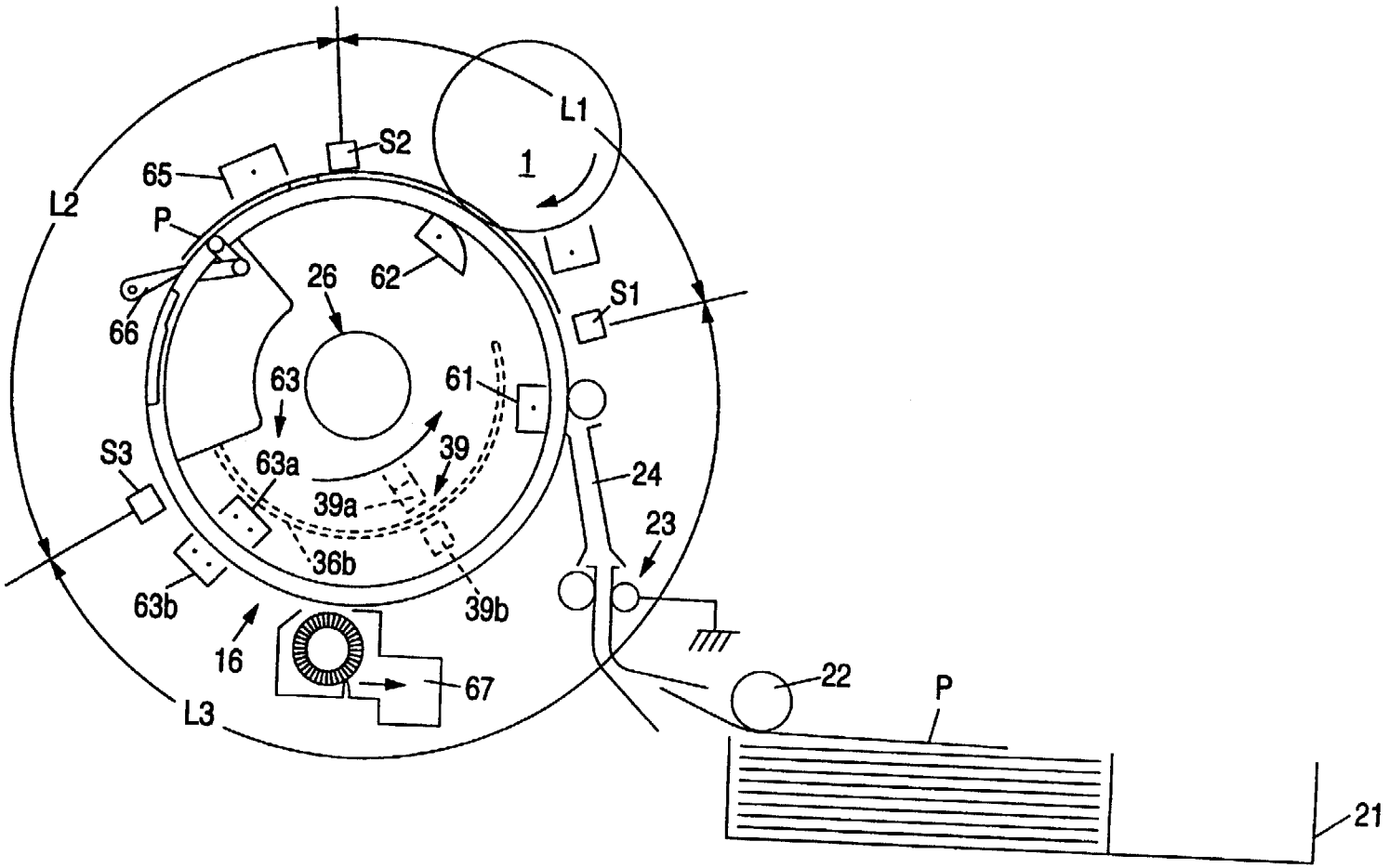
FIG. 2 is an enlarged view illustrating Embodiment 1 of the transfer material detecting device shown in FIG. 1.

The transfer drum supporting shaft 26 supports a suction corotron 61, a transfer corotron 62, and an inner discharge corotron 63*a* which are shown in FIGS. 1 and 2. The corotrons 61, 62, and 63*a* supported by the transfer drum supporting shaft 26 are disposed inside the transfer drum 27. An outer discharge corotron 63*b* is disposed outside the transfer drum 27 at a position corresponding to the inner discharge corotron 63*a*. The outer discharge corotron 63*b* is supported by an appropriate frame member. The inner and outer discharge corotrons 63*a* and 63*b* constitute a discharge corotron 63.

Referring to FIGS. 1 and 2, transfer material sensors S1, S2, and S3 are disposed along the outer periphery of the transfer drum 27. The transfer material sensors S1 to S3 are arranged in this sequence in the rotation direction of the transfer drum 27. The distances between the transfer material sensors S1 and S2, S2 and S3, and S3 and S1 are L1, L2, and L3 (see FIG. 2), respectively. In the embodiment, the distances are set so as to be $L1 \leqq L2 \leqq L3$. The minimum distance L1 between the transfer material sensors S1 and S2 is shorter than the minimum length of a transfer material (transfer sheet) P which will be used. Specifically, the digital printer U of Embodiment 1 is designed so that the minimum size of the transfer material P to be transported is the B5S size (182 mm) in the transportation direction, and hence the minimum distance L1 between the transfer material sensors S1 and S2 is set to be equal to or shorter than 182 mm. When the transfer drum 27 is rotated under the state where the transfer material P is sucked to the transfer material carrier 31, therefore, the transfer material sensors S1 and S2 simultaneously detect the transfer material P so as to produce the state where both the sensors are ON.

The transfer material sensor S1 is disposed downstream from the suction corotron 61, the transfer material sensor S2 is disposed downstream from the transfer corotron 62, and the transfer material sensor S3 is disposed upstream to the discharge corotron 63.

Between the transfer material sensors S2 and S3, a separation corotron 65 and a separation finger 66 are arranged in this sequence in the rotation direction of the transfer drum 27. The separation corotron 65 is a corotron for discharging the transfer material P which is electrostatically sucked to the transfer material carrier 31, and departing the material from the carrier.

A cleaning device 67 for the transfer material carrier is disposed between the discharge corotron 63 and the suction corotron 61.

Referring to FIG. 1, the digital printer U comprises a transport path 69 which guides the transfer material P separated from the transfer material carrier 31 by the separation finger 66, to a fixing device 68. The fixing device 68 has a heating roll 68*a*, and a pressure roll 68*b*.

The digital printer U further comprises a discharge roll 71 which consists of a driving roll 71*a* and a driven roll 71*b*, and a transport path 72 which guides the transfer material P to which the toner image is fixed, from the fixing device 68 to the discharge roll 71.

The digital printer U further comprises a transfer material discharge tray 73 which accommodates the transfer material P discharged from the discharge roll 71.

Figure 8:
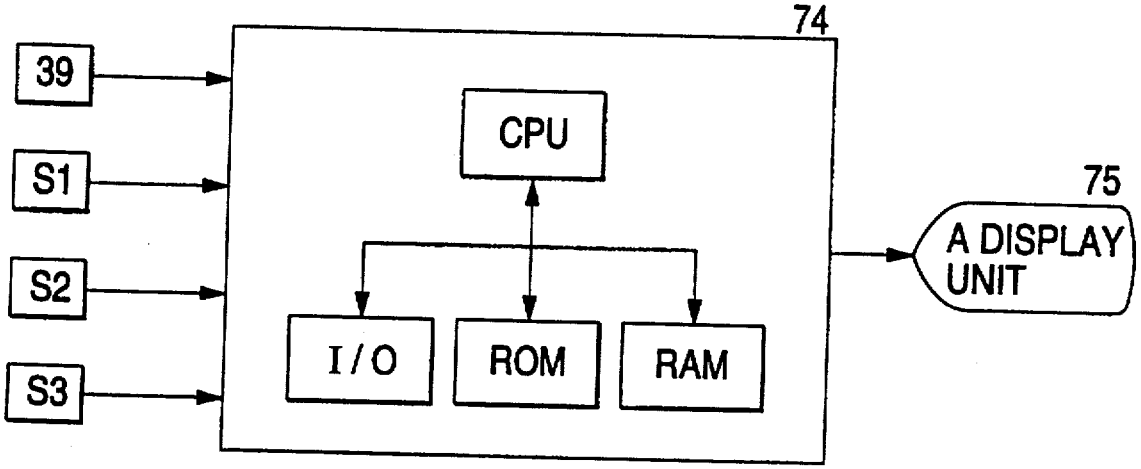
FIG. 8 is a diagram illustrating the main portion of circuits used in Embodiment 1.

FIG. 8 is a diagram illustrating the main portion of circuits used in Embodiment 1.

The detection signals of the drum position sensor 39, and the transfer material sensors S1 to S3 are input to a microcomputer 74. The microcomputer 74 comprises a CPU (central processing unit), an I/O (input/output interface), a ROM (read-only memory), and a RAM (random access memory). The microcomputer 74 operates in accordance with programs stored in the ROM so as to realize various functions.

The microcomputer 74 controls a display unit 75 of the digital printer U so as to display predetermined data.

Next, the function of Embodiment 1 will be described.

In synchronization with the formation of a toner image on the rotating image carrier 1, the transfer material P is transported at a predetermined timing by the registration roll 23 to the suction position of the transfer drum 27 through the paper chute 24. The timing of transporting the transfer material P is set so that the front end of the transfer material P is sucked to a position where is slightly downstream from the drum tie plate 30 of the transfer drum 27. Under the state where the front end of the transfer material P is sucked to a position where is slightly downstream from the drum tie plate 30, the transfer material P is sucked to the transfer material carrier 31. This suction is performed by an electrostatic suction force which is generated as a result of the discharge of the suction corotron 61.

The transfer material P which is carried in a portion of the transfer drum 27 which is downstream from the drum tie plate 30 as described above is transported at a predetermined timing to a position opposing the image carrier 1, i.e., the transfer region B.

In the transfer region B, the discharge of the transfer corotron 62 causes a toner image of a first color is transferred to the transfer material P.

The transfer drum 27 continues to be rotated while holding the transfer material P to which the toner image of the first color is transferred, so that the transfer material P is again transported to the transfer region B. Then a toner image of a second color is transferred in the transfer region B. This process is further repeated two times, with the result that toner images of the four colors (yellow, magenta, cyan, and black) are transferred in a multiplex manner to the transfer material P so that a color image is formed.

Figure 9:
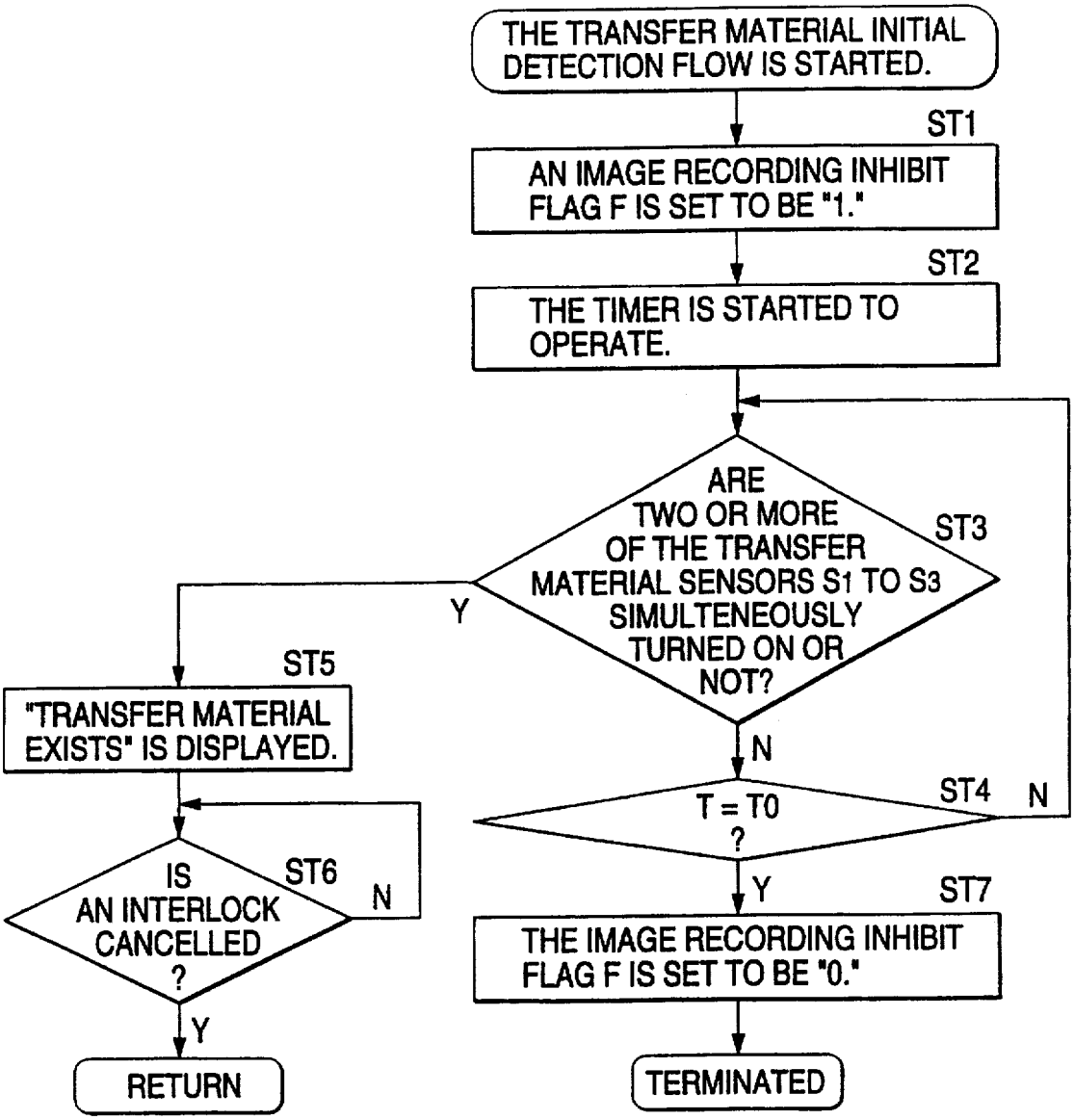
FIG. 9 is a flowchart of a transfer material initial detection flow in the transfer material detecting device of Embodiment 1.

The microcomputer 74 executes the transfer material initial detection flow shown in FIG. 9 on the occasion such as when the power source of the digital printer U is turned on, or when the image recording operation is to be started (or a jam is cleared).

Referring to FIG. 9, when the transfer material initial detection flow is started, an image recording inhibition flag is set to be "1" in step ST1.

Next, in step ST2, the counted time T of a timer is reset to be 0 and then the timer is started to operate.

In step ST3, it is judged whether two or more of the transfer material sensors S1 to S3 are simultaneously turned ON or not. If no (N), the process proceeds to step ST4, and, if yes (Y), the process proceeds to step ST5.

In step ST5, "transfer material exists" is displayed on the display unit 75, and the operation of a copy start button is disabled.

Then it is judged in step ST6 whether an interlock is canceled or not. If no (N), step ST6 is repeated. When the user opens a door, a cover, or the like of the image forming apparatus U, removes a jamming transfer material P, and then closes the door, the cover, or the like, a switch which is operated in accordance with the closing operation causes the interlock to be canceled.

If yes (Y) in step ST6, the transfer material initial detection flow is started from the beginning.

In step ST4, it is judged whether T=To or not. In the above, To is a time which is to be elapsed from the start of the rotation of the transfer drum 27 and before the completion of one turn. If no (N) in step ST4, the process returns to step ST3, and, if yes (Y), the process proceeds to step ST7. The situation where the judgment is yes (Y) in step ST4 means that two or more of the transfer material sensors S1 to S3 fail to be simultaneously turned ON during the period when the transfer drum 27 makes one turn, or that the transfer material P is not detected.

Therefore, the image recording inhibition flag is set in step ST7 to be "0", and then the transfer material initial detection flow is terminated.

Figure 10:
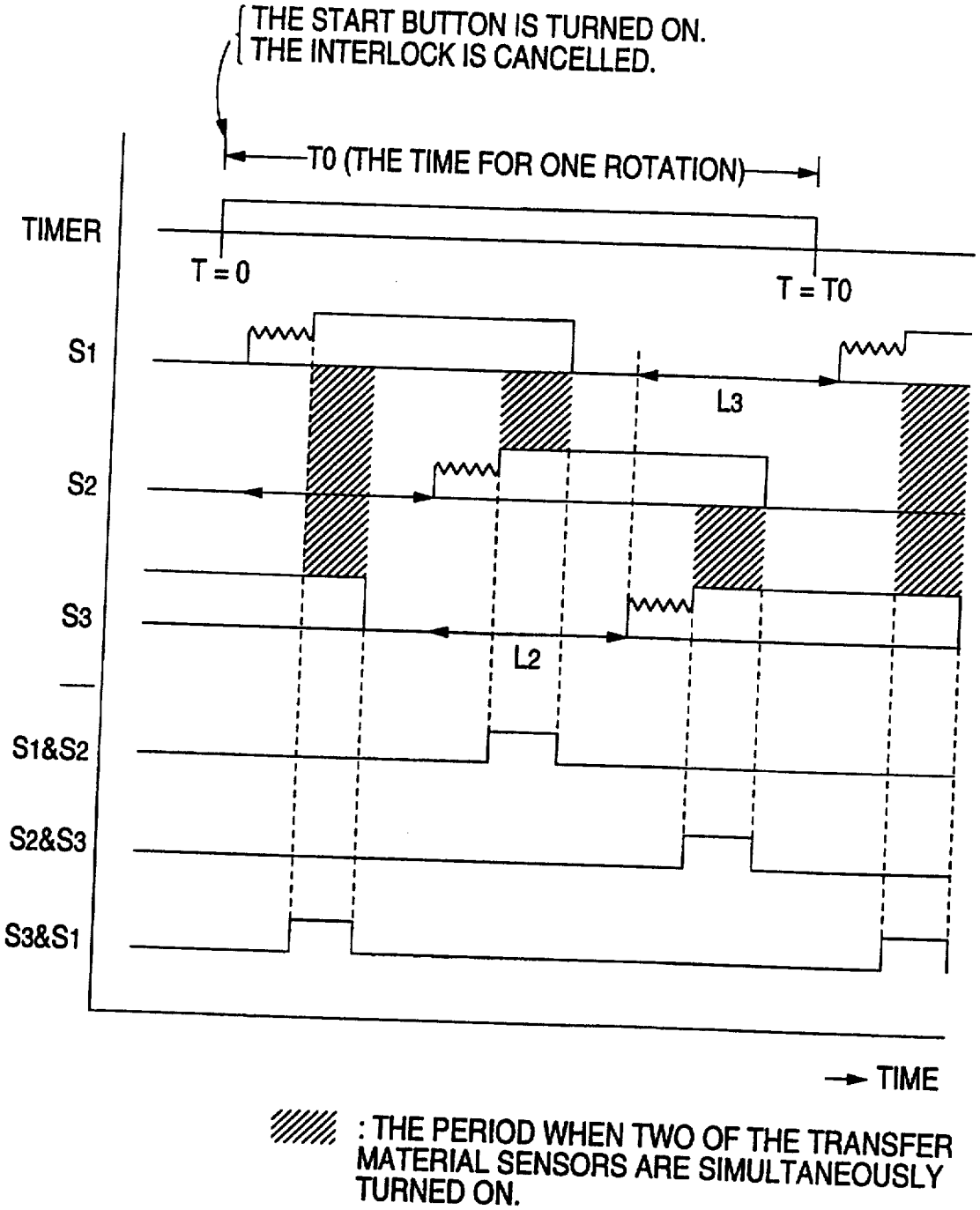
FIG. 10 is a time chart of detection signals of the transfer material sensors used in Embodiment 1.

FIG. 10 is a time chart of the detection signals of the transfer material sensors S1 to S3 used in Embodiment 1.

During a period elongating from the start of the operation of the timer to the time when the value of the timer becomes from T=0 to T=T0, i.e., a period when the transfer drum 27 completes one turn, the transfer material sensors S1 to S3 sequentially detect the drum tie plate 30 and the transfer material P.

The distance L1 between the transfer material sensors S1 and S2 is set to be equal to or shorter than the preset minimum size B5S (the shorter length of a sheet of B5 size=182 mm) of the transfer material P which is used in the digital printer U. When a transfer material P larger than the size B5S is carried by the transfer drum 27, therefore, two of the transfer material sensors S1 to S3 are simultaneously turned ON during the period when the transfer drum 27 makes one turn.

Since it is judged that a transfer material exists when two of the transfer material sensors S1 to S3 are simultaneously turned ON, an error (erroneous detection) in which existence of a transfer material is done based on light reflected from the drum tie plate 30 is completely prevented from occurring.

Embodiment 2 of the transfer material detecting device of the invention will be described with reference to FIGS. 1, 2, and 11.

In the description of Embodiment 2, components corresponding to those of Embodiment 1 are designated by the same reference numerals, and their detail description is omitted.

Embodiment 2 is configured in the same manner as Embodiment 1 except the following points.

The transfer material sensor S2 of Embodiment 1 is omitted.

The drum position sensor 39 detects the rotation position of the transfer drum 27 (i.e., the relative position between the drum tie plate 30 and the drum position sensor 39), and existence of the transfer material P is detected on the basis of a detection signal of the transfer material sensor S1 or S3 obtained when the downstream side portion of the transfer drum 27 except the drum tie plate 30 is at a position opposing the transfer material sensor S1 or S3.

Next, the function of Embodiment 2 will be described.

As shown in FIGS. 1 and 2, the positions of the drum position sensor 39 and the transfer material sensors S1 and S3 are fixed. As seen from FIG. 4, immediately after the drum position sensor 39 disposed across the light shield wall **36*b* is changed from the OFF state to the ON state, the portion of the drum tie plate 30 passes over the drum position sensor 39. As seen from FIGS. 2, 5, and 11, etc., in the case where the transfer material P which is sucked to a portion of the transfer drum 27 which is downstream from the drum tie plate 30, the sucked transfer material P exists at the position opposing the transfer material sensor S3 at the time when the drum position sensor 39 is changed from the OFF state to the ON state. In this case, therefore, existence of the transfer material P can surely be detected on the basis of the detection signal of the transfer material sensor S3 obtained when the drum position sensor 39 is changed from the OFF state to the ON state. When the drum position sensor 39 is inversely changed from the ON state to the OFF state, the sucked transfer material P exists at the position opposing the transfer material sensor S1. In this case, therefore, existence of the transfer material P can surely be detected on the basis of the detection signal of the transfer material sensor S1 obtained when the drum position sensor 39** is changed from the ON state to the OFF state.

Figure 11:
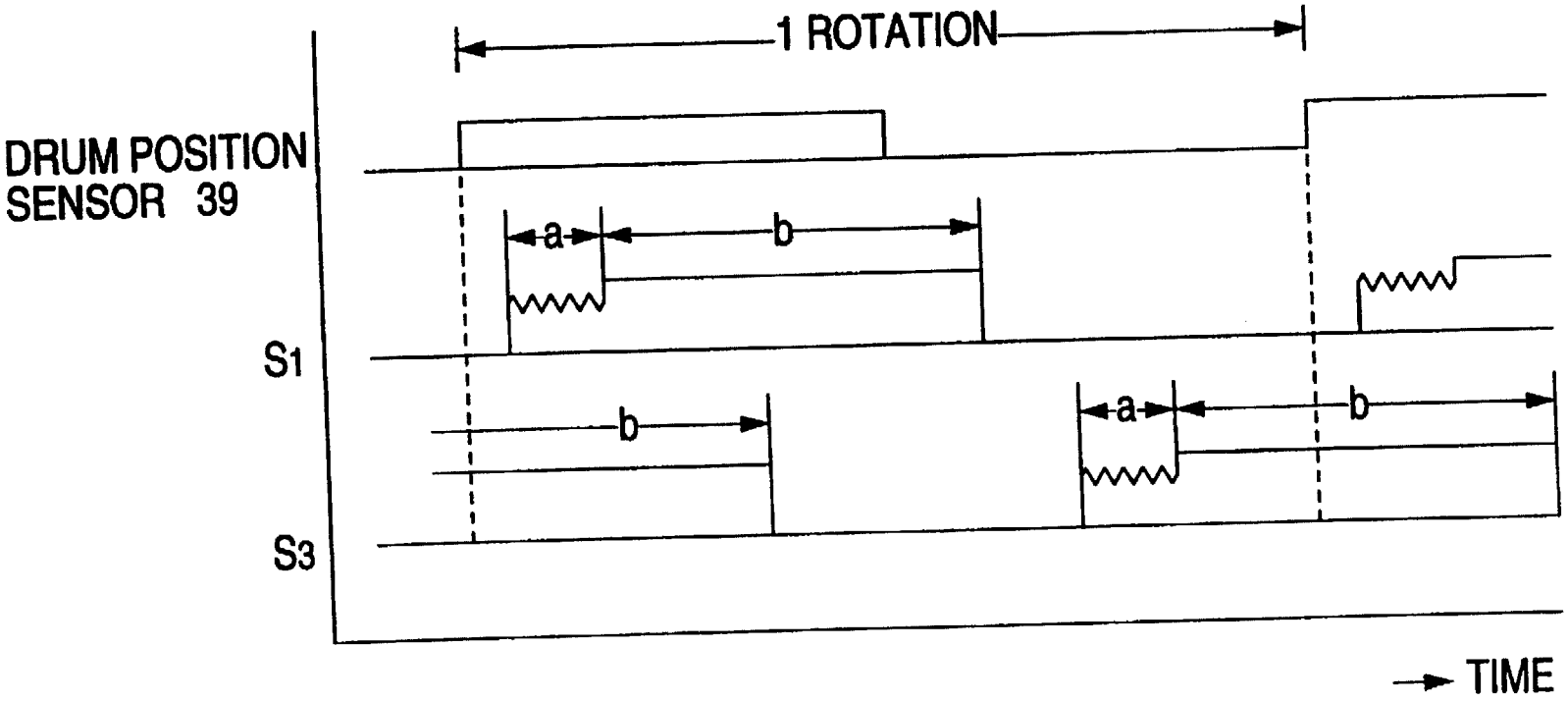
FIG. 11 is a time chart of detection signals of a drum position sensor 39, and transfer material sensors S1 and S3 in the state where a transfer material P of the length B is sucked to a portion of a transfer drum 27 which is-downstream from a drum tie plate 30.

FIG. 11 is a time chart of the detection signals of the drum position sensor 39, and the transfer material sensors S1 and S3 obtained in Embodiment 2 when the length in the circumferential direction of the drum tie plate 30 of the transfer drum 27 has a length a, and the transfer material P sucked to the portion downstream from the drum tie plate 30 has a length b.

As seen from FIG. 11, existence of the transfer material P can be detected on the basis of the detection signal of the transfer material sensor S3 obtained when the drum position sensor 39 is changed from the OFF state to the ON state, and that of the transfer material sensor S1 obtained when the drum position sensor 39 is changed from the ON state to the OFF state.

Since existence of the transfer material P is detected on the basis of the detection signal obtained when the state of the drum position sensor 39 is changed, the detection of existence of the transfer material P can be conducted two times for each turn of the transfer drum. In other words, existence of the transfer material P can surely be detected for each ½-rotation of the transfer drum.

Figure 12:
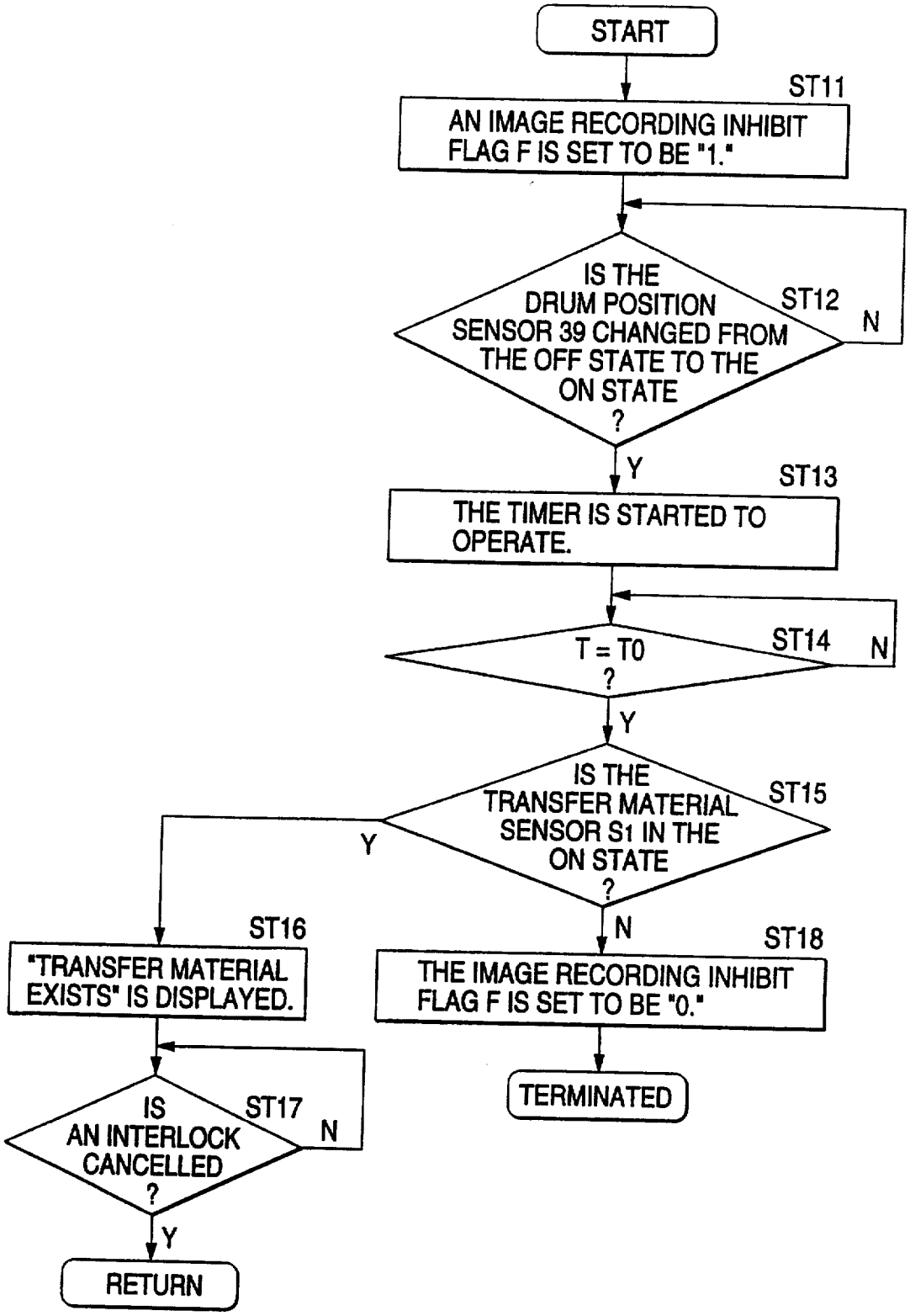
FIG. 12 is a flowchart of the transfer material initial detection flow in Embodiment 3.
Figure 13:
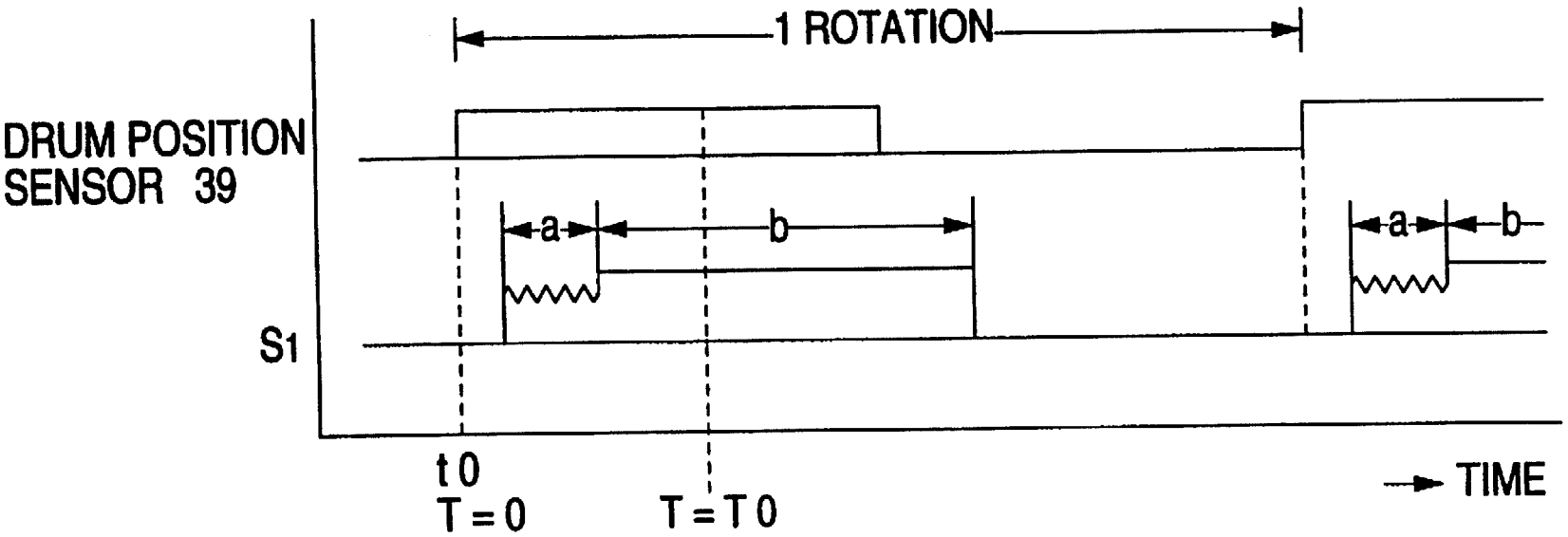
FIG. 13 is a time chart of detection signal of a transfer material sensor S1 used in the transfer material detecting device of Embodiment 3.
Figure 14:
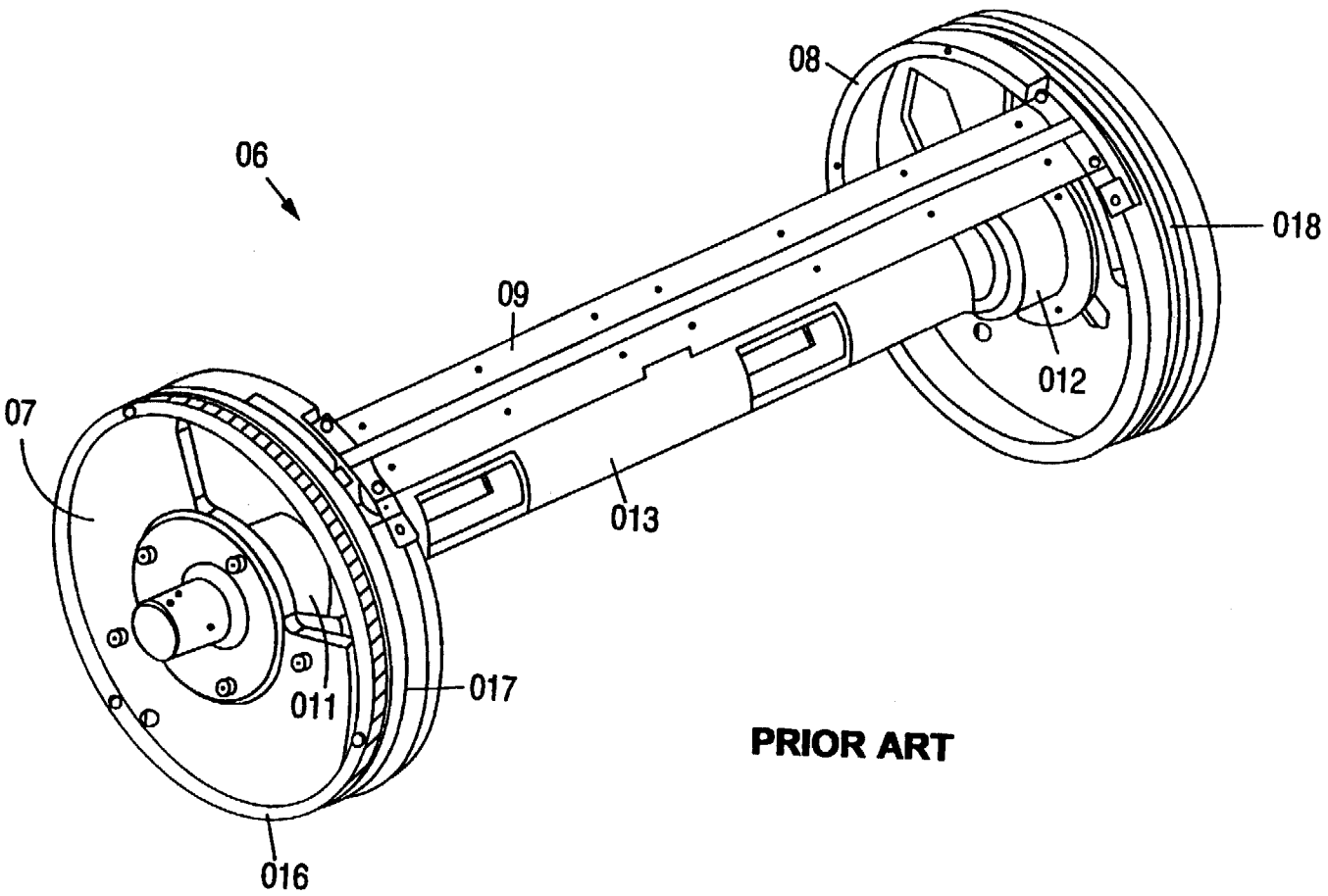
FIG. 14 is a diagram of the prior art and illustrating a transfer drum.

FIG. 12 is a flowchart of the transfer material initial detection flow in Embodiment 3, and FIG. 13 is a time chart of the detection signal of the transfer material sensor S1 used in the transfer material detecting device of Embodiment 3.

In the description of Embodiment 3, components corresponding to those of Embodiment 1 are designated by the same reference numerals, and their detail description is omitted.

Embodiment 3 is configured in the same manner as Embodiment 1 shown in FIGS. 1 to 8 except the following points.

The transfer material sensors S2 and S3 of Embodiment 1 are omitted.

The drum position sensor 39 detects the rotation of the transfer drum 27, and the existence of the transfer material P is detected on the basis of the detection signal of the transfer material sensor S1 obtained when the portion of the transfer drum 27 which is downstream from the drum tie plate 30 is at a position opposing the transfer material sensor S1.

Next, the function of Embodiment 3 will be described with reference to FIGS. 12 and 13.

The microcomputer 74 (see FIG. 8) executes the transfer material initial detection flow shown in FIG. 13 on the occasion such as when the power source of the digital printer U is turned on, when the image recording operation is to be started, or when a jam is cleared.

Referring to FIG. 12, when the transfer material initial detection flow is started, the image recording inhibition flag is set to be "1" in step ST11.

Next, in step ST12, it is judged whether the drum position sensor 39 is changed from the OFF state to the ON state. If no (N), step ST12 is repeatedly executed, and, if yes (Y), the process proceeds to next step ST13. The time when the judgment is changed to yes (Y) is indicated by t0 in FIG. 13.

Next, in step ST13, the counted time T of a timer is reset to be 0 and then the timer is started to operate.

In step ST14, it is judged whether T=T0 or not. If no (N), step ST14 is repeatedly executed, and, if yes (Y), the process proceeds to next step ST15. As seen from FIG. 13, the situation where the judgment is yes (Y) is produced at the time when the transfer material sensor S1 opposes the portion (portion to which the transfer material is to be sucked) of the transfer drum 27 which is downstream from the drum tie plate 30 (the region of the detection signal a in FIG. 13).

It is judged in step ST15 whether the transfer material sensor S1 is in the ON state or not. If yes (Y), "transfer material exists" is displayed in step ST16, and the operation of the copy start button is disabled.

Then it is judged in step ST17 whether an interlock is canceled or not. If no (N), step ST17 is repeated. When the user opens a door, a cover, or the like of the image forming apparatus U, removes a jamming transfer material P, and then closes the door, the cover, or the like, a switch which is turned ON or OFF in accordance with the closing or opening operation causes the interlock to be canceled.

If yes (Y) in step ST17, the transfer material initial detection flow is started from the beginning.

The situation where the judgment is yes (Y) in step ST15 means that there is no transfer material P. Therefore, the image recording inhibition flag F is set in step ST18 to be "0", and then the transfer material initial detection flow is terminated.

In the above, embodiments of the invention have been described. The invention is not restricted to these embodiments, and may be modified in various manners without departing from the scope of the invention described in the accompanying claims. Modifications of the invention will be described below.

In the embodiments, a portion 30*a* (see FIG. 6) of the drum tie plate 30 which passes over a region R (see FIG. 6) detected by the transfer material sensors S1 to S3 may be configured so that light is not reflected from the portion by, for example, coloring it in black, thereby preventing the transfer material sensors S1 to S3 from outputting the signal indicative of existence of a transfer material (in other words, attaining the state where the signal indicative of nonexistence of a transfer material is output).

The transfer material carrier may be formed by an endless belt in place of the surface of a cylindrical transfer drum.

The image forming apparatus of the invention can attain the effect described below.

The existence of a transfer material on the transfer material carrier can be detected rapidly and surely.

What is claimed is:

1. A transfer material detecting device, comprising:

a transfer material carrier that detachably carries a transfer material to transport said transfer material to a transfer region where a toner image of an image carrier is transferred to the transfer material;

at least two transfer material sensors disposed along an outer periphery and in a moving path of said transfer material carrier at intervals that are shorter than a minimum size of a transfer material to be detected; and a means for outputting a transfer material detection signal when two or more of said transfer material sensors simultaneously detect an existence of the transfer material.

2. The transfer material detecting device of claim 1, further comprising:

a transfer drum member, wherein said transfer drum member comprises:

a pair of drums having a cylindrical transfer material carrier supporting face in an outer peripheral portion; and a drum connecting member that integrally connects said pair of drums with each other while separating said pair of drums from each other by a predetermined distance, wherein said drum connecting member has a belt-like transfer material carrier supporting face, and wherein said transfer drum is capable of being rotated when carrying said transfer material carrier on said cylindrical transfer material carrier supporting face.

3. The transfer material detecting device according to claim 1, wherein said means for outputting a transfer material detection signal prevents further acceptance of additional transfer material.

4. A transfer material detecting device, comprising:

a transfer material carrier that detachably carries a transfer material to transport the transfer material to a transfer region where a toner image of an image carrier is transferred to the transfer material;

at least two transfer material sensors disposed along an outer periphery and in a moving path of said transfer material carrier at intervals that are shorter than a minimum size of a transfer material to be detected, wherein said at least two transfer material sensors detect an existence of a transfer material carried by said transfer material carrier;

a transfer drum member, wherein said transfer drum member comprises:

a pair of drums having a cylindrical transfer material carrier supporting face in an outer peripheral portion; and a drum connecting member that integrally connects said pair of drums with each other while separating said pair of drums from each other by a predetermined distance, said drum connecting member having a belt-like transfer material carrier supporting face, wherein said transfer drum member is capable of being rotated when carrying said transfer material carrier on said cylindrical transfer material carrier supporting face;

a carrier position detecting means for detecting a rotation position of said transfer material carrier; and a means for outputting a transfer material detection signal when said at least two transfer material sensors detect an existence of a transfer material in a region other than said drum connecting member.

5. The transfer material detecting device according to claim 4, wherein said means for outputting a transfer material detection signal prevents further acceptance of additional transfer material.

6. A transfer material detecting device, comprising:

a transfer material carrier that detachably carries a transfer material to transport the transfer material to a transfer region where a toner image of an image carrier is transferred to the transfer material;

at least two transfer material sensors disposed along an outer periphery and in a moving path of said transfer material carrier, wherein said at least two transfer material sensors detect an existence of a transfer material carried by said transfer material carrier; and a transfer drum member, wherein said transfer drum member comprises:

a pair of drums;

a drum connecting member that integrally connects said pair of drums with each other while separating said pair of drums from each other by a predetermined distance, said drum connecting member having a belt-like transfer material carrier supporting face; and a cylindrical transfer material carrier supported by said transfer material carrier supporting face and said pair of drums;

wherein said transfer drum member is capable of being rotated when carrying said transfer material carrier on said cylindrical transfer material carrier supporting face; and wherein a region of said belt-like transfer material carrier supporting face is capable of sending a signal indicative of a nonexistence of a transfer material, and wherein said signal is detected by said transfer material sensors.

7. The transfer material detecting device according to claim 6, wherein said means for outputting a transfer material detection signal prevents further acceptance of additional transfer material.

8. A transfer material detecting device, comprising:

a transfer material carrier that detachably carries a transfer material to transport said transfer material to a transfer region where a toner image of an image carrier is transferred to the transfer material;

a signal emitting device located on said transfer material carrier;

at least two transfer material sensors disposed in a moving path of said transfer material carrier at intervals that are shorter than a minimum size of a transfer material to be detected; and a means for outputting a transfer material detection signal when two or more of said transfer material sensors simultaneously detect an existence of the transfer material.

9. The transfer material detecting device of claim 8, wherein said signal emitting device is a light emitting device.

10. A transfer material detecting device, comprising:

a transfer material carrier that detachably carries a transfer material to transport the transfer material to a transfer region where a toner image of an image carrier is transferred to the transfer material;

transfer material sensors disposed in a moving path of said transfer material carrier at intervals that are shorter than a minimum size of a transfer material to be detected, wherein said at least two transfer material sensors detect an existence of a transfer material carried by said transfer material carrier;

a transfer drum member, wherein said transfer drum member comprises:

a pair of drums having a cylindrical transfer material carrier supporting face in an outer peripheral portion;

a drum connecting member that integrally connects said pair of drums with each other while separating said pair of drums from each other by a predetermined distance, said drum connecting member having a belt-like transfer material carrier supporting face; and a signal emitting device located on said transfer drum member, wherein said transfer drum member is capable of being rotated when carrying said transfer material carrier on said cylindrical transfer material carrier supporting face;

a carrier position detecting means for detecting a rotation position of said transfer material carrier; and a means for outputting a transfer material detection signal when said at least two transfer material sensors detect an existence of a transfer material in a region other than said drum connecting member.

11. The transfer material detecting device of claim 10, wherein said signal emitting device is a light emitting device.

12. A transfer material detecting device, comprising:

a transfer material carrier that detachably carries a transfer material to transport the transfer material to a transfer region where a toner image of an image carrier is transferred to the transfer material;

at least two transfer material sensors disposed in a moving path of said transfer material carrier, wherein said at least two transfer material sensors detect an existence of a transfer material carried by said transfer material carrier; and a transfer drum member, wherein said transfer drum member comprises:

a pair of drums;

a drum connecting member that integrally connects said pair of drums with each other while separating said pair of drums from each other by a predetermined distance, said drum connecting member having a belt-like transfer material carrier supporting face;

a signal emitting device located on said transfer drum member; and a cylindrical transfer material carrier supported by said transfer material carrier supporting face and said pair of drums;

wherein said transfer drum member is capable of being rotated when carrying said transfer material carrier on said cylindrical transfer material carrier supporting face; and wherein a region of said belt-like transfer material carrier supporting face is capable of sending a signal indicative of a nonexistence of a transfer material, and wherein said signal is detected by said transfer material sensors.

13. The transfer material detecting device of claim 12, wherein said signal emitting device is a light emitting device.

* * * * *